United States Patent [19]

Nakajima

[11] Patent Number: 4,516,381

[45] Date of Patent: May 14, 1985

[54] AUTOMATIC CARTON PACKING MACHINE

[75] Inventor: Mutsuhiko Nakajima, Soka, Japan

[73] Assignee: Ace Pak Company Incorporated, Japan

[21] Appl. No.: 523,741

[22] Filed: Aug. 16, 1983

Related U.S. Application Data

[62] Division of Ser. No. 250,282, Apr. 2, 1981, Pat. No. 4,448,013.

[51] Int. Cl.[3] ..... B65B 57/00

[52] U.S. Cl. ..... 53/375; 53/272

[58] Field of Search ..... 53/375, 379, 373, 374, 53/378, 565, 272–276; 493/164–167, 178, 184, 185, 151, 70, 80–81

[56] References Cited

U.S. PATENT DOCUMENTS 3,566,762 3/1971 Vadas ..... 53/375 X

*Primary Examiner*—A. J. Heinz

*Attorney, Agent, or Firm*—McGlew and Tuttle

[57] ABSTRACT

A carton shifting device for use in an automatic carton packing machine, comprises a disc supporting a plurality of downwardly extending mandrels. The mandrels are arranged in pairs with outwardly facing surfaces lying in a common plane. A groove is defined in each outer surface of the mandrel. The paired grooves are engageable by a pair of claws connected to a withdrawing bar for movement in the downward-like direction to strip carton blanks off the mandrels. The carton blanks drop on a table where they are pushed into two rows by a pushing bar. At the end of the rows a horizontal conveyor moves to convey the carton blanks in an orderly fashion. The conveyor comprises a chain with a plurality of spaced apart rectangular blanks. The blanks are spaced apart by the carton blank length with the width of each blank being equal to two carton blank widths so that two carton blanks can be conveyed between adjacent blocks.

2 Claims, 42 Drawing Figures

AUTOMATIC CARTON PACKING MACHINE

This is a division of application Ser. No. 250,282 filed Apr. 2, 1981 now U.S. Pat. No. 4,448,013.

BACKGROUND OF THE INVENTION

The present invention relates to an apparatus for forming a carton for use as a container for liquids such as cow's milk, fruit juice or the like. The apparatus also fills the carton with the liquid, and forms and seals the carton top. More particularly, the present invention presents a device for shifting carton blanks with bottoms that are sealed in the above-mentioned apparatus, to a bucket conveyor, with disclosure of construction of the bucket conveyor, construction of a folding device for shaping the top of the carton that is filled with the liquid and the construction of a device for treating the triangular projection (lug) formed when the carton top is formed into a flat shape.

The apparatus for forming the carton, filling the carton, forming the carton top and sealing the same will be generally referred to as an "automatic carton packing machine", hereinafter. The automatic carton packing machine is required to fulfill various requirements such as high treating capacity (yield), compactness, and so forth. In addition, the automatic packing machine is required for processing of cartons irrespective of their shape.

In a conventional automatic carton packing machine, carton blanks with sealed bottoms are placed in a frame of a chain conveyor one by one, and a series of operations such as filling of cartons with the liquid, formation of the carton top and sealing of the same are performed while the carton blanks are conveyed by the chain conveyor. Therefore, there is a practical limit in the speed of operation. Particularly, the step shifting of the carton blanks with sealed bottoms to the frame of the chain conveyor, after withdrawal of the same from the mandrel, is made at an extremely low efficiency which inconveniently limits the efficiency of the work.

Turning to FIG. 1A to FIG. 1F and FIG. 2A to FIG. 2F, there are two types of foldings of carton tops after filling thereof with liquid: namely a flat top as shown in FIGS. 1A to 1F and gable top as shown in FIGS. 2A to 2F. Hitherto, these shapes of the carton tops were formed by different folding devices. In other words, for obtaining both of these two types of the carton tops, it has been necessary to employ two different devices. In the case of the flat carton top as shown in FIG. 1F, triangular projections or lugs are formed at each side of the carton top. It is necessary to fold these lugs down onto both side surfaces of the carton, because such lugs will otherwise hinder the transportation, storage and display of the cartons. To this end, it has been necessary to employ a suitable measure or arrangement such as provision of an elongated guide in the direction of running of the chain conveyor, to fold down the lugs toward the side surfaces of the carton. This requires, however, an impractically long length of the machine as a whole.

SUMMARY OF THE INVENTION

It is, therefore, a first object of the invention to make it possible to array the carton, which are withdrawn from the mandrels, on a table and to shift these cartons at a high efficiency and speed to the bucket conveyor.

It is a second object of the invention to provide a form of the bucket conveyor which facilitates the treatment of the triangular projections or lugs of the flat top type carton.

It is a third object of the invention to provide a machine which is capable of producing both the flat top type carton and the gable top type carton.

It is a fourth object of the invention to make it possible to treat the rectangular portion of the flat top type carton at high efficiency and speed.

It is a fifth object of the invention to reduce the size of the machine as a whole.

To this end, according to the invention, there is provided an automatic carton packing machine comprising: a withdrawing device adapted to withdraw carton blanks having sealed bottoms the withdrawing device having fitting mandrels extending vertically downwardly therefrom; a push-out device adapted for successively pushing out the carton blanks in the horizontal direction on a table; a conveyor device including bucket portions arranged at a right angle to the direction of pushing out and for accomodating the carton blanks in a row and flat portions formed at both sides of the bucket portions; a folding device adapted to fold the upper edge of the carton tops along a line to impart a folding habit to the carton top; and a device for treating triangular lugs of the carton top which are adapted for bending, after completion of the sealing of the carton top having folding habit and withdrawal of the carton blanks from the buckets of the conveyor device, the triangular lugs of the carton being folded downwardly and bonded to the side surfaces of the carton.

Other objects and advantageous features of the invention will become clear from the following description of the preferred embodiments taken in conjunction with the accompanying drawings.

DETAILED DESCRIPTION OF THE PREFERRED EMBODIMENTS

Figure 3:
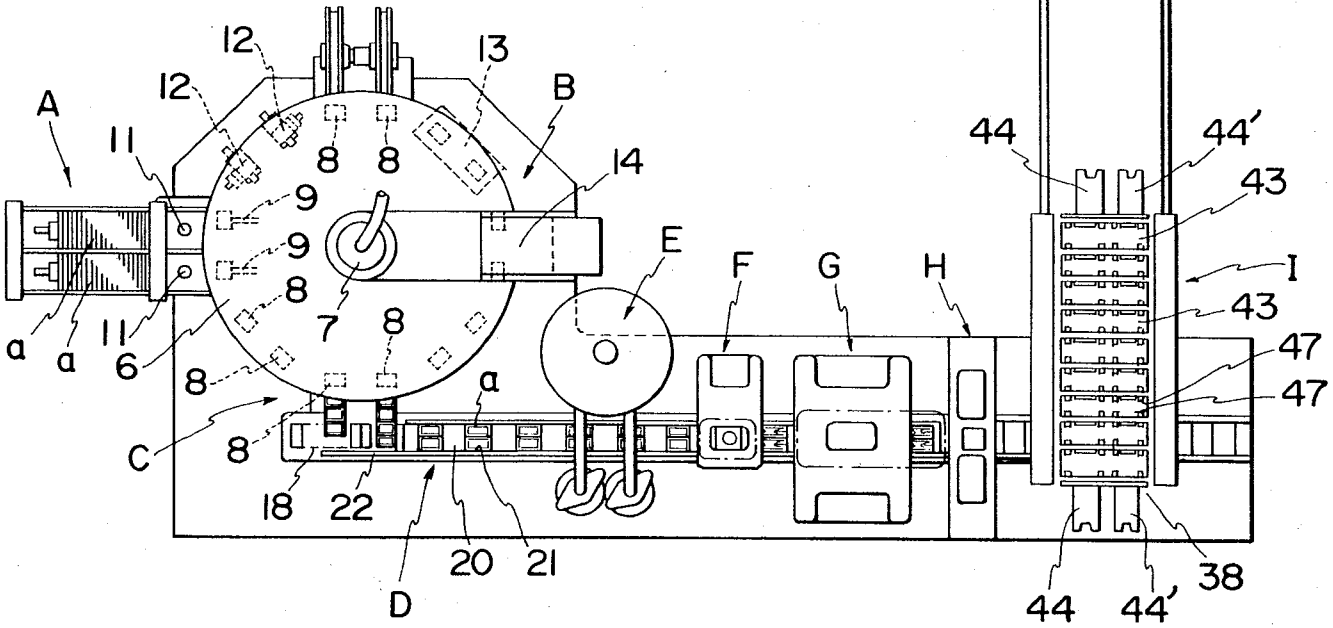
FIG. 3 is a plan view of an entire automatic carton packing machine according to the invention.
Figure 4:
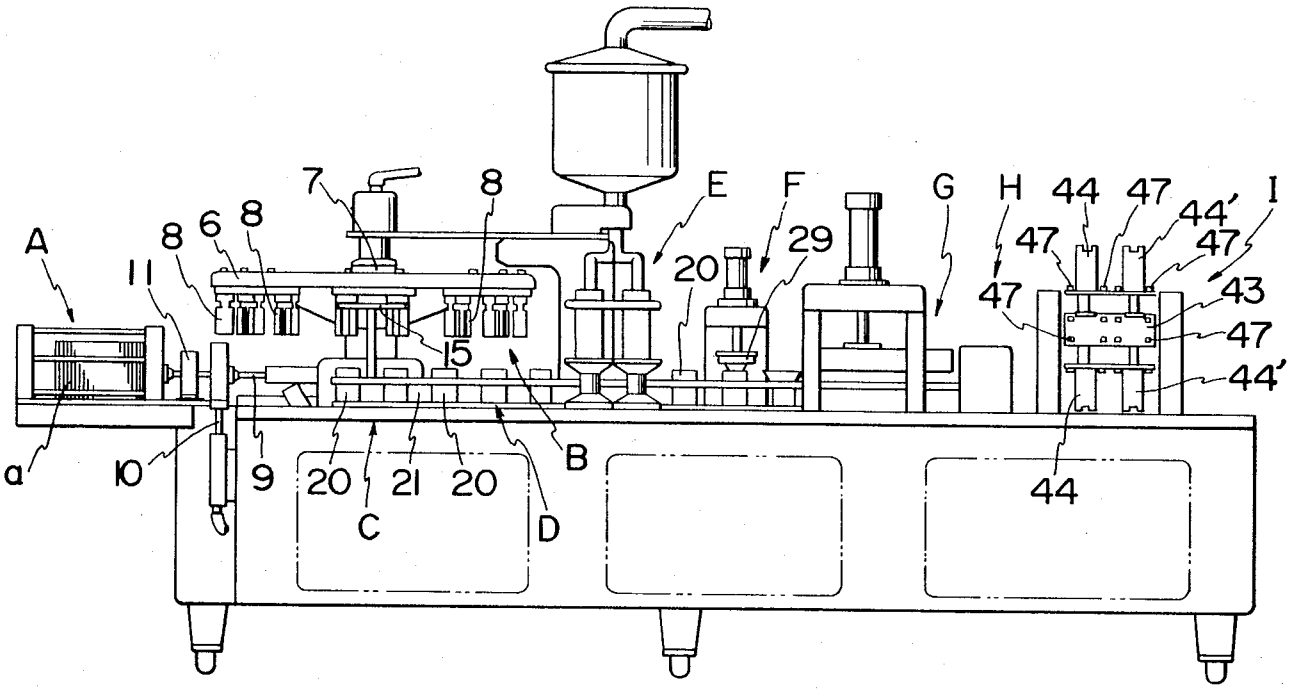
FIG. 4 is a front elevational view of the machine shown in FIG. 3.

FIGS. 3 and 4 show the whole of an automatic carton packing machine in accordance with the present invention.

Figure 1A:
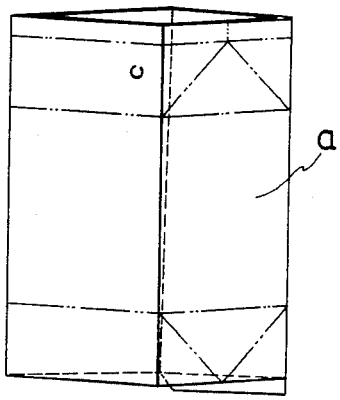
FIGS. 1A to 1F are perspective views showing a sequential process for forming a flat top type carton and sealing the top of the carton.
Figure 1B:
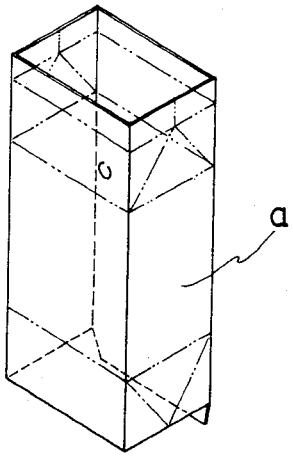
Figure 1D:
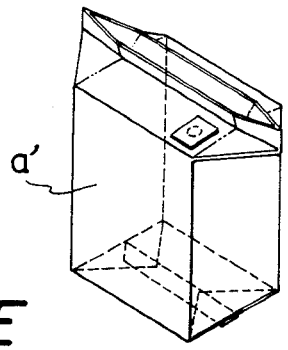
Figure 1C:
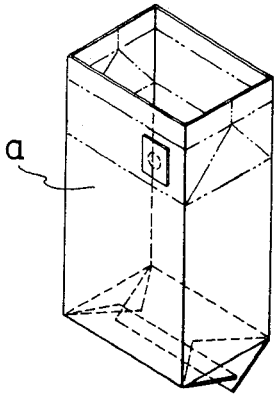
Figure 2A:
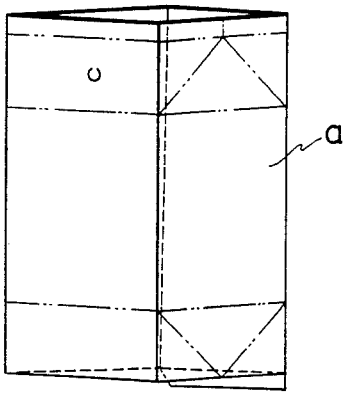
FIGS. 2A to 2F are perspective views showing a sequential process for forming a gable top type carton and sealing the top of the carton.
Figure 2B:
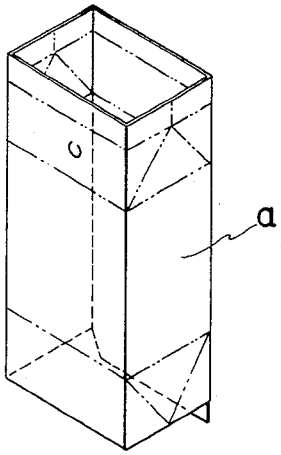
Figure 2D:
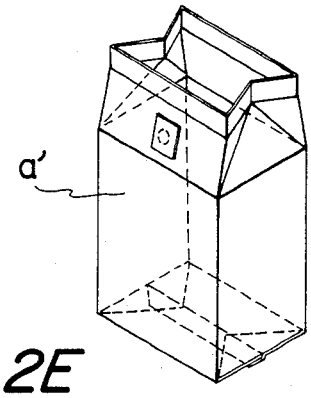
Figure 2C:
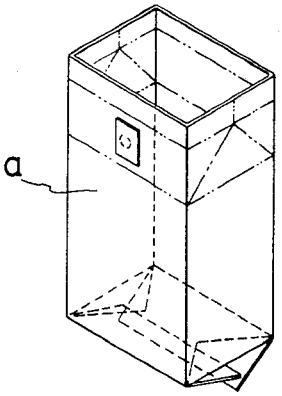

Referring to these Figures, a symbol A designates a magazine which accomodates carton blanks folded in a flat form. The state of these flattened carton blank a in magazine A corresponds to FIGS. 1A and 2A. A symbol B denotes a bottom sealing device or means adapted for sealing the bottom of the carton blanks which are extracted from the magazine. A shifting device or means for shifting the cartons with sealed bottoms to a conveyor device D, is designated at a symbol C. A symbol E designates a filling device for filling the carton blanks held in the buckets of the conveyor device D with a liquid to a predetermined level.

A reference symbol F denotes a folding device for imparting a folding habit to the openings of the cartons which have been filled with the liquid, by folding the same along the folding line.

For clarity, the cartons, before they are filled with liquid, will be referred to as "carton blanks" a, while the cartons that are filled with liquid will be referred to as "cartons" a'.

A reference symbol G designates a heating device for heating the opening of the cartons a' having the folding habit, while H denotes a sealing device for sealing the tops of the cartons a' after the heating operation.

Finally, a symbol I designates a treating device for treating the triangular lugs formed on the flat top of the cartons a' during the folding and sealing operations.

The automatic carton packing machine of the invention is made up by the devices or means mentioned above. The operation of each of these devices will be explained hereinafter.

The magazine A is of a known type and accomodates a plurality of carton blanks a as illustrated. A pressure is applied to the rear side of these blanks to push them forward. Means are provided for supplying additional carton blanks as the number of carton blanks in the magazine A becomes small.

Figure 5:
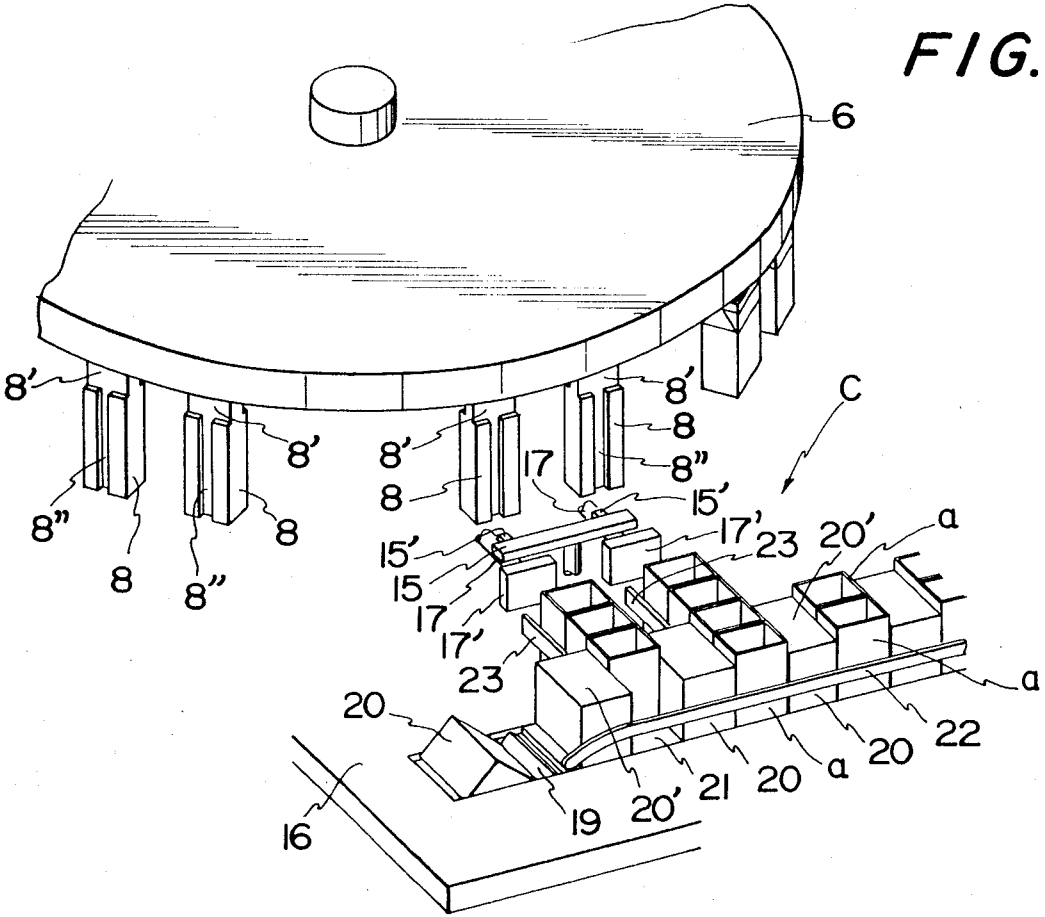
FIG. 5 is a perspective partial view of a shifting device including discs, mandrels and a conveyor.

As seen in FIGS. 3 and 4 and partly in FIG. 5, the bottom sealing device B has a horizontal disc 6 attached to a central shaft 7, with two rectangular mandrels 8 projecting downwardly from the disc 6 positionable, at a time, near the magazine A. Each mandrel B is provided with relief grooves 8' and withdrawal grooves 8''. The bottom sealing device B includes a vacuum bar 9 for withdrawing the carton blanks a horizontally from the magazine A, guide rollers 11 adapted to open the carton blanks a into rectangular form upon abuting a portion of each carton blank after withdrawal thereof from the magazine A by the vacuum bar 9, a push-up bar from pushing up the carton blanks a which are opened in the rectangular form up to fit the same to the mandrels 8, a folding device 12 for imparting a folding habit to the carton blanks a which are fitting to the mandrels, a bottom heating device 13 for heating the bottoms of the carton blanks and a bottom sealing device 14 for collapsing the heated bottoms of the carton blanks to seal the bottoms.

The above-described construction of the bottom sealing device B is known. The discs 6 are adapted to rotate intermittently and clockwise in FIG. 3, and various operations mentioned above are performed during a suspension of rotation of the discs 6.

The shifting device C, which is shown in detail in FIG. 5, constitutes an essential part of the invention. This shifting device C includes a withdrawing bar 15 having a withdrawing claw 15' adapted to engage the top edge of the carton blanks a having sealed bottoms. Shifting device C includes a table 16 on which the carton blanks are placed after the withdrawal of the carton blanks. The device C includes a push-out bar 17 having a push-out plate 17' adapted to push the carton blanks out onto the table 16 in the horizontal direction, and a guiding frame 23 mounted on the table 16 and adapted for guiding the carton blanks a so that the latter move in a row. The withdrawing bar 15 is adapted to be actuated by a pneumatic cylinder. Withdrawing claws 15' of the same construction are provided at front and rear sides of the bar 15 so that each carton blank a is clamped at front and rear sides thereof when it is withdrawn.

The push-out bar 17 is also actuated by a pneumatic cylinder, so as to effect a repetitious operation to push-out the carton blanks a, which have been withdrawn by the withdrawing bar 15 and placed on the table 16, one by one. The pushing out of the carton blanks a is made during returning of the withdrawing bar 15 and the push-out bar 17 is reset when the withdrawing bar 15 starts the withdrawing operation. The withdrawing bar 15 and the push-out bar 17 may be actuated by a cam mechanism.

Figure 6:
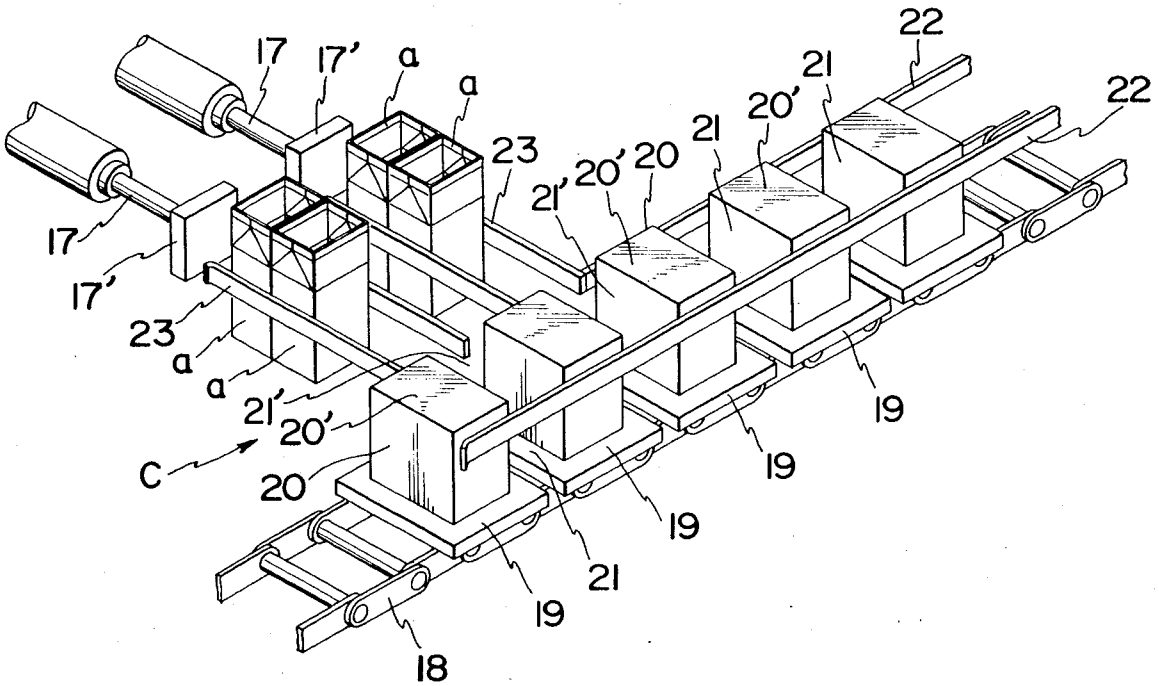
FIG. 6 is a perspective view of the shifting device.
Figure 7:
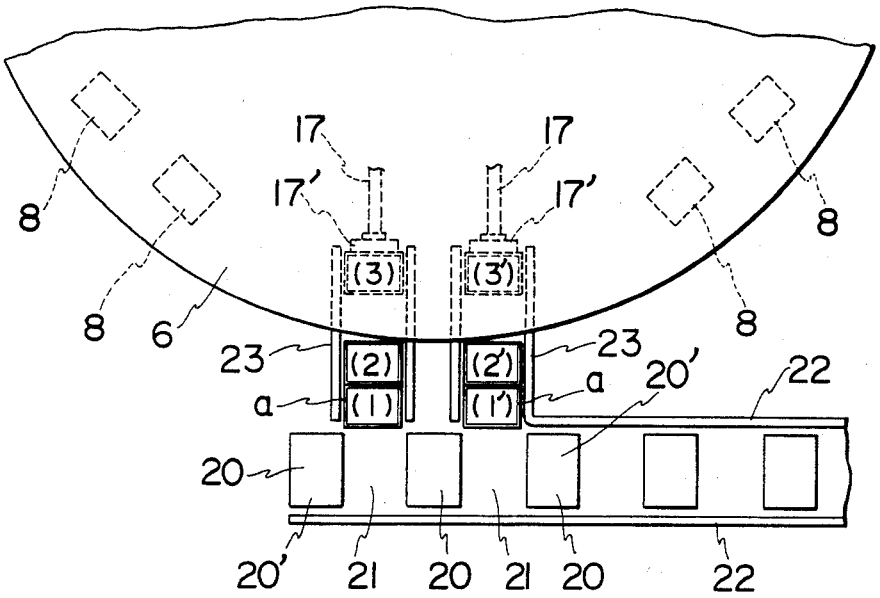
FIGS. 7 to 11 are plan views showing the steps of operation of the shifting device.

As will be seen from FIGS. 4, 5 and 6, the conveyor device D includes a chain 18 disposed at one side of the bottom shifting device C so as to run in the direction perpendicular to the direction of pushing out of the carton blanks a, rectangular blocks 20 mounted on bottom plates 19 of the chain 18, bucket portions or spaces 21 defined between adjacent blocks 20, and a guide rail 22 disposed in the vicinity of the blocks 20 and arranged along the movement path of the block 20 (chain 18). The bucket portions 21 is open at their upper sides and at their sides perpendicular to the direction of running. The height of the flat top surfaces 20' of the blocks 20 are equal to the height of the carton blanks a less the height of the top seal of the blanks.

The guide frame 23 comprises a plurality of pairs of parallel guide rails and is so arranged that the ends of the rails are positioned at both sides of the opened sides 21' of the bucket portions 21 when the latter are stopped. In the illustrated embodiment, each bucket portion 21 has a length for just receiving two carton blank widths and has a width of one blank.

The shifting device C has a construction as explained above. The chain 18 is adapted to run intermittently in a timed relation to the intermittent running of the conveyor device D, and the shifting operation of the device is made in a sequence shown in FIGS. 7 to 11.

Figure 8:
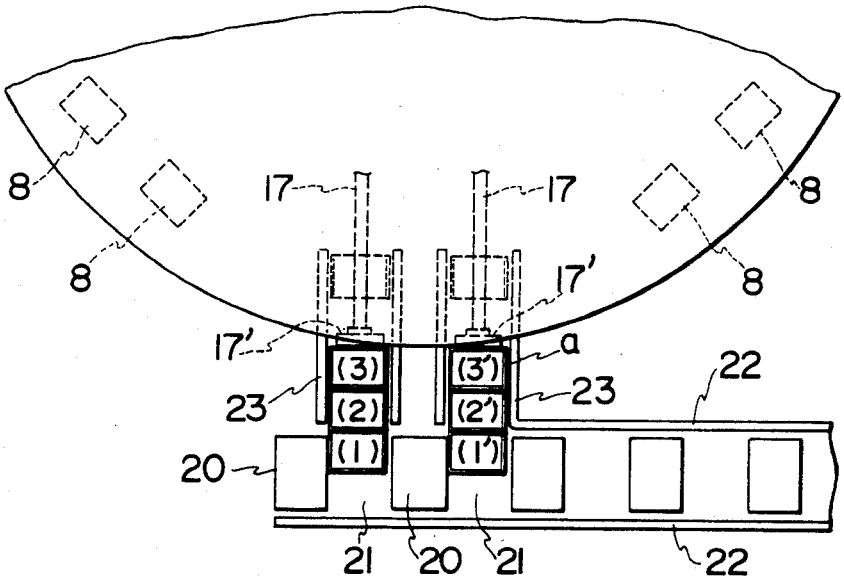
Figure 9:
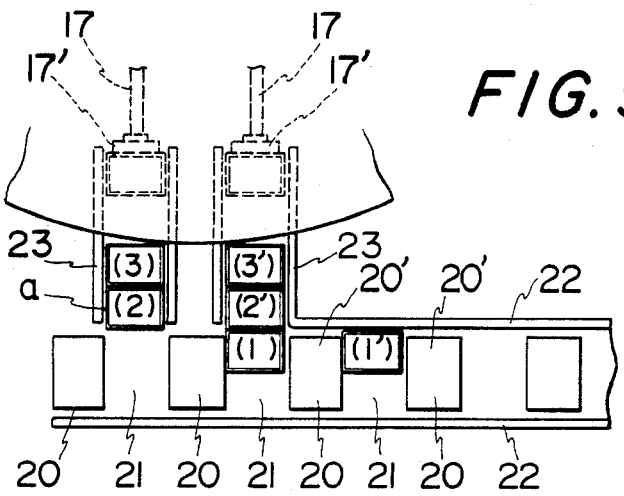
Figure 10:
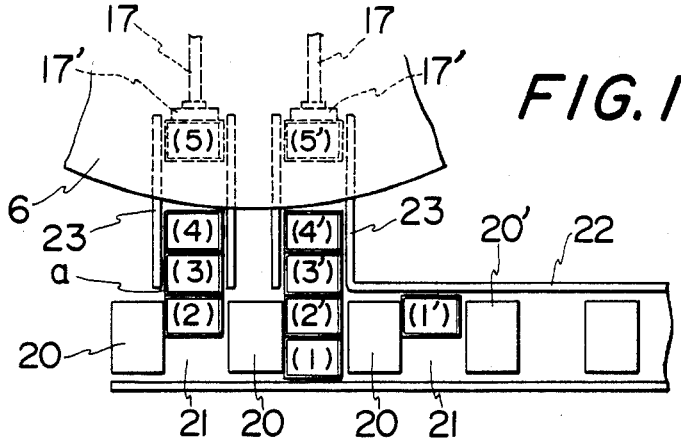
Figure 11:
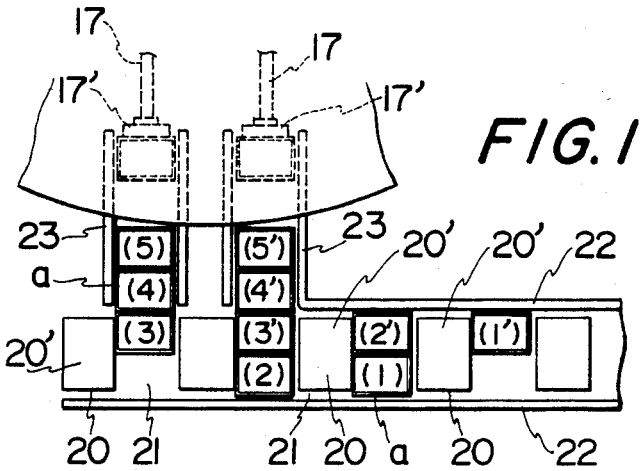
Figure 30:
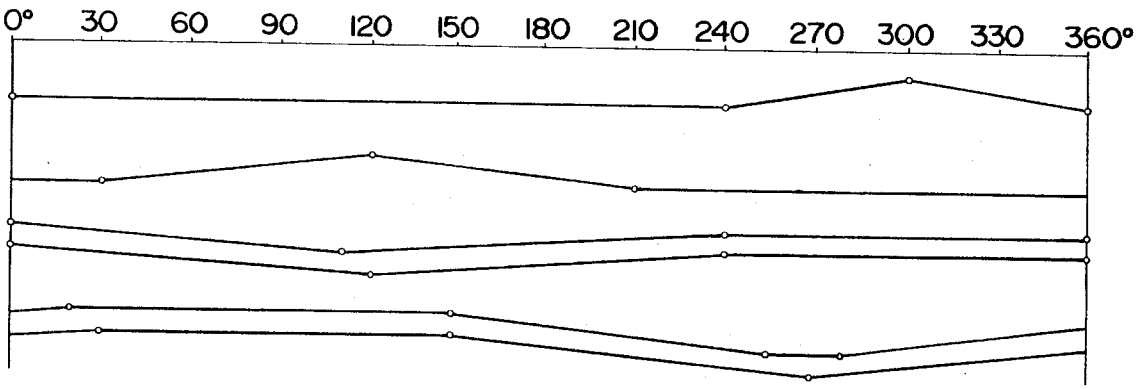
FIG. 30 is a timing chart of operations of the disc, bucket portion, withdrawing bar, and push-out bar.

Two carton blanks a are withdrawn from the mandrel 8 by the withdrawing bar 15 as shown in FIG. 5, and are placed on the table 16 in a side-by-side relation. Then, the push-out bar 17 is actuated to push one carton blank a, out. As this operation is repeated, in the state shown in FIG. 7, three carton blanks 1,2,3; 1',2',3' are arrayed in each row, in the guide frame 23. Push-out bar 17 is then advanced by a distance corresponding to one carton blank, so that the carton blanks 1,1' at the leading sides of both rows are pushed into the bucket portion 21 of the conveyor 18, as illustrated in FIG. 8. Thereafter, two new carton blanks are withdrawn from the mandrels 8 and placed at the trailing ends of both rows in the guide frame 23. Meanwhile, the chain 18 runs a distance corresponding to one spacing of the bucket portions 21 and is then stopped (See FIG. 9). The push-out bar 17 is then actuated again while the bucket 21 is stopped to push one carton 4,4' of each row so that the leading carton blanks 2,2' are pushed into the new bucket portion 21. As a result of this pushing operation, the carton blank 1, which is one of the carton blanks 1,2 pushed into the bucket portion 21 in advance, is pushed by the new carton blank 2' by one width of the carton blanks, into the bucket portion 21, so that this bucket portion now receives two carton blanks 1,2'. Then, a new pair of carton blanks 5,5' are withdrawn from the mandrels 8. Meanwhile, the chain 18 runs and stops after moving over a distance corresponding to one spacing between the bucket portions 21. Thereafter, the push-out bar 17 is actuated again to push the new carton blanks 5,5' by one width of the carton blanks a, so that the third carton blanks 3,3' are forced into the bucket portion 21, in such a manner that the carton blank 3' pushes the carton blank 2 deeper into the bucket Portion 21 by one width of the carton blank a, so that this bucket portion 21 accomodates two carton blanks 2,3' as will be seen from FIG. 11. This operation is repeated to charge two carton blanks into each of the successive bucket portions 21. The discs 6, bucket portion 21 (chain conveyor 18), carton withdrawing bar 15 and the carton push-out bar 17 operate in accordance with a timing chart shown in FIG. 30.

As explained above, the shifting device is so constructed as to withdraw the carton blanks from the mandrels vertically downwardly, to push out the withdrawn carton blanks a by one width of the carton blanks and to slide the carton blanks laterally into respective bucket portions 21. Since the operation of each part is a repetition of a simple linear action, it is comparatively easy to obtain such a setting that the time length in which the operation is stopped is elongated while the time length in which each part moves is shortened.

In the case of the disc 6, it is possible to preserve a considerably long time of stopping or suspension of rotation for various operations, such as folding of the bottoms of the carton blanks, sealing of the same, and the withdrawal of the carton blanks, while shortening the time for rotation of the disc. Particularly, in the case of the bucket portion, it is quite convenient to preserve a time sufficiently long for various operations, such as filling of the carton with its content, folding of the carton top and sealing of the same, while shortening the running period. The disc 6 and the bucket portion 21 operate at different conditions of timing. The difference of operation timing, however, can be adjustable and absorbable by the timing of the withdrawal of the carton blanks and the timing of pushing out of the same. It is, therefore, possible to obtain, in the shifting device in accordance with the invention, an optimum relation of operation timing between the disc 6 and the bucket portion 21.

The carton blanks a are kept in a vertical posture during the shifting and are never turned over nor rotated, so that the shifting of the carton blanks is made in quite a smooth way. In addition, since the bucket portion 21 is so sized as to accomodate two carton blanks, the efficiency is doubled as compared with that of the conventional chain conveyor in which each bucket portion can accomodate only one carton blank. In addition, the invention can be modified without substantial difficulty to meet a requirement such as to increase the capacity of each bucket portion to accomodate three carton blanks. In such a case, it is possible to obtain an efficiency which is three times as high as that of the conventional shifting device. It is also to be noted that the shifting device in accordance with the invention occupies only a small area so that the size of the machine as a whole can be reduced considerably.

The automatic filling device E is a known one which is adapted to fill the container up to a predetermined level. The folding device F is positioned at the downstream side of the automatic filling device E as viewed in the direction of flow of the carton blanks. There are two types of folding device: namely a folding device for flat top type cartons and a folding device for gable top type carton blanks. The folding device can be replaced with another type of folding device depending on the type of the cartons, i.e. in accordance with the shape of the carton top to be treated.

Figure 12:
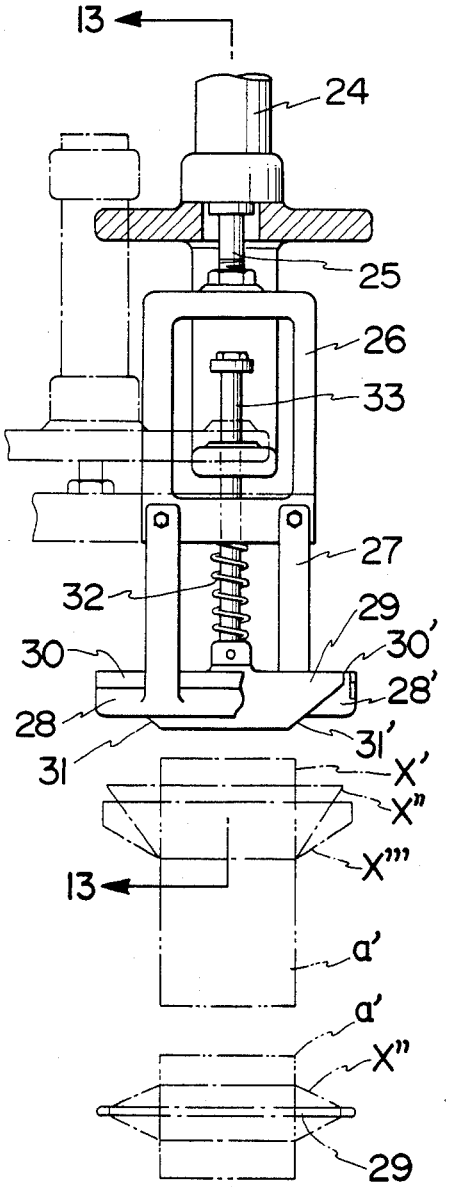
FIG. 12 is a front elevational view of a folding device for imparting a folding habit to the top of a flat top type carton.
Figure 13:
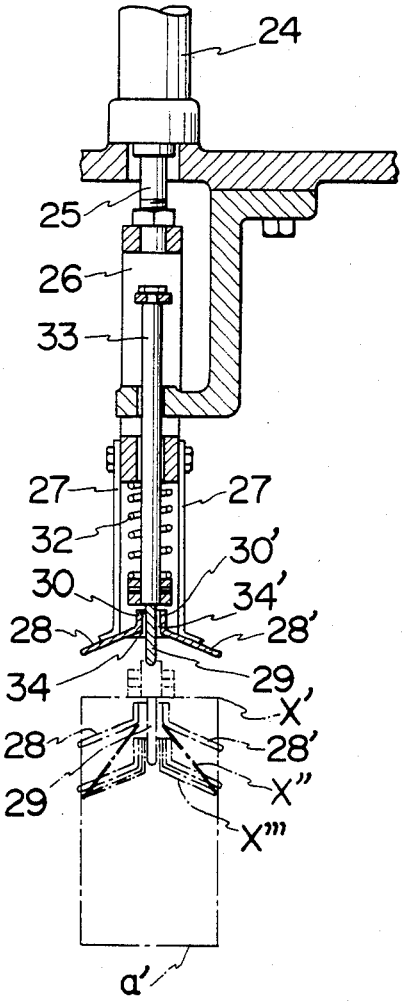
FIG. 13 is a sectional view taken along the line 13—13 of FIG. 12.

FIGS. 12 and 13 show the folding device adapted for making a folding habit of the flat top type. This device includes a rectangular frame 26 attached to a shaft 25 of a pneumatic cylinder 24, with squeezing plates 28,28' attached to the frame 26 in such a manner as to oppose each other, by plates 27. An expander plate 29 is also included which is positioned between the squeezing plates in a vertical posture and is carried by a shaft 33 for movement up and down relative to the squeezing plates 28,28'.

In the above-described construction, the upper ends 30,30' of the squeezing plates 28,28' are bent in the vertical direction to preserve a space therebetween, and the expander plate 29 is positioned in this space. Reference numerals 34,34' denote gaps between the upper ends 30,30' of the squeezing plates 28,28' and opposing sides of the expander plate 29. Each of these gaps is selected to be slightly greater than the thickness of the sheet material constituting the cartons a'. The expander plate 29 has an inverted trapezoidal form and has cut corners 31,31'. A reference numeral 32 designates a coiled spring wound around the shaft 33 and adapted to relieve motion of the shaft 33 (expander plate 29) upward and for self-resetting the plate 29 into its lowered position on frame 26.

Figure 14:
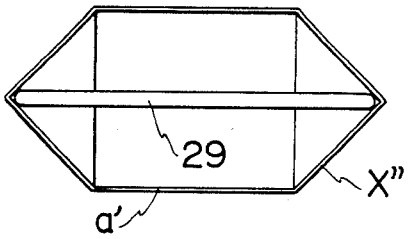
FIGS. 14 and 15 are illustrations of an operation of the folding device for flat top type carton.
Figure 15:
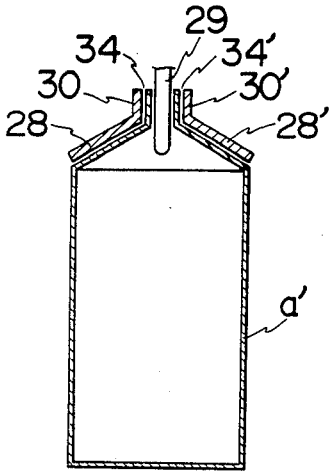

In the operation of the folding device for the flat carton tops, described heretofore, the frame 26 is lowered by the operation of the pneumatic cylinder 24 as shown in FIG. 14, so that the expander plate 29 comes into contact with the center of the upper end of the carton a' to open the upper end of the carton a' laterally by the action of the tapered surfaces of the cut corners 31,31'. In consequence, the carton is opened and has a hexagonal plan. At the same time, the squeezing plates 28,28' urge the upper edges of the carton toward the expander plate 29, so that the upper edges of the carton a' come into the gaps 34,34' as shown in FIG. 15. In FIG. 12, sequential states of deformation of the carton a' are shown at X',X' and X''' respectively.

After imparting the folding habit to the carton a' in the manner explained above, the pneumatic cylinder 24 is actuated to raise the frame 26, so that the carton a' is moved away from the expander plate 29 and the squeezing plates 28,28', thereby to complete the folding operation leaving the folding habit in the carton top. Thus, the folding operation is completed by one reciprocating motion of the device.

Figure 18:
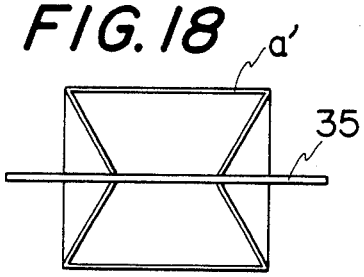
FIG. 18 is an illustration of an operation of the folding device for the gable top type container.
Figure 16:
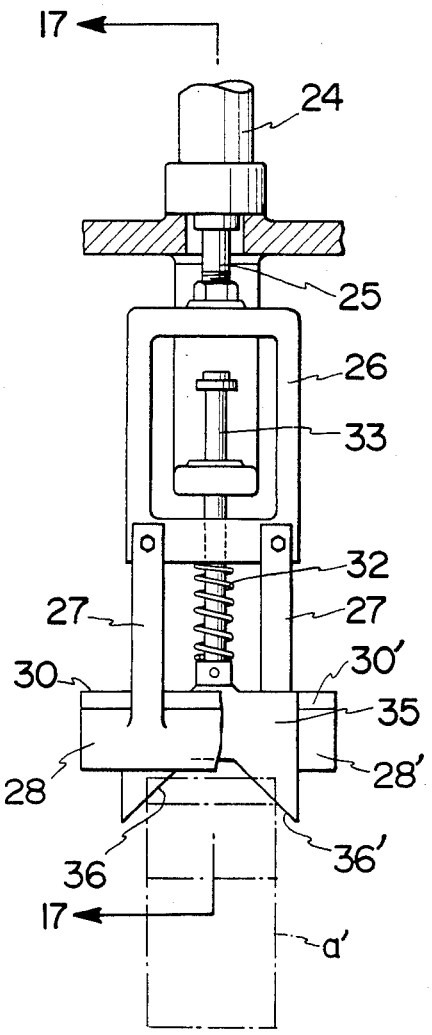
FIG. 16 is a front elevational view of a folding device for imparting a folding habit to the top of a gable top type container.
Figure 17:
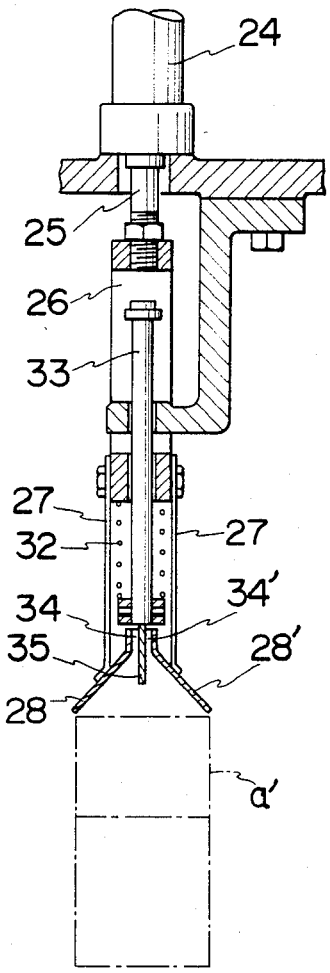
FIG. 17 is a sectional view taken along the line 17—17 of FIG. 16.

The folding device of another type, i.e. the folding device for gable top type cartons, is shown in FIGS. 16 and 17. This folding device has major parts such as the frame 26, squeezing plates 28,28' and so forth identical to those of the folding device for the flat top type. The sole difference resides in that the folding device for the gable top type carton incorporates a pressing plate 35 in place of the expander plate 25. Instead of the cut corners 31,31' of the expander plate 29, the pressing plate 35 is provided at its central portion with trapezoidal pressing tapers 36 36'. In operation, the frame 26 is lowered to bring the pressing tapers 36,36' into contact with the left and right upper edges of the carton a' from the outsides. Then, as the pressing plate 35 is lowered further, the left and right upper edges are folded inwardly as shown in FIG. 18. At this point, as in the case of the operation illustrated in FIG. 15 the front and rear upper edges of the carton a' are brought together by the action of the squeezing plates 28,28'. The frame 26 is then raised, leaving the gable top type folding habit in the carton top.

It is possible to obtain a constant folding habit because the top of the carton a' is beforehand provided with lines of folding and the folding is made along these creases.

As will be understood from the foregoing description, the sole difference between the folding device for the flat top type carton and the folding device for the gable top type carton resides in that, while the former incorporates the expander plate 29, the latter employs the pressing plate 35. Other portions of these two devices are identical. It is, therefore, possible to obtain two types of foldings of the carton tops, i.e. the flat top and the gable top, simply by replacing the expander plate 29 with the pressing plate 35 and vice versa. It will be seen that there is no necessity of having two different types of folding devices for the two kinds of foldings.

The heating device G for heating the top of the cartons a' having the folding habit is of a known type, and is adapted to blow hot air from a nozzle toward the carton tops, to heat and melt the polyethylene layer coating the surface of the cartons a'.

Figure 1E:
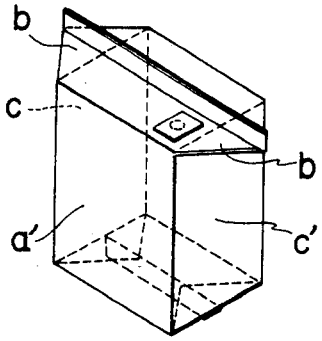
Figure 19:
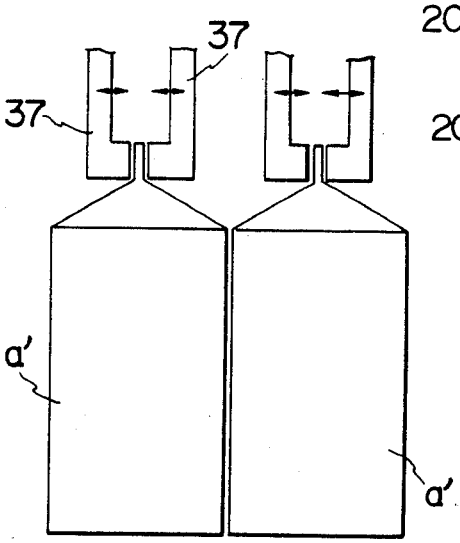
FIG. 19 is a side elevational view illustrating a top seal device.
Figure 20:
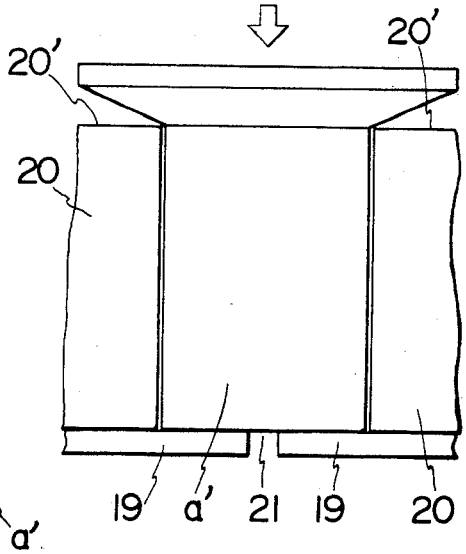
FIG. 20 is a front elevational view of the top seal device shown in FIG. 19.

As will be seen from FIG. 19, the sealing device H for linearly sealing the carton tops, incorporates smoothing irons 37 adapted to be pressed toward both sides of the heated carton tops. In the case where the carton is of the flat top type, the irons 37 are then lowered to collapse this portion of the carton top, onto the upper faces 20' of the adjacent blocks 20 of the conveyor device D. This state is shown at FIG. 20. The carton a' in this state takes a form as shown in FIG. 1E.

Figure 2E:
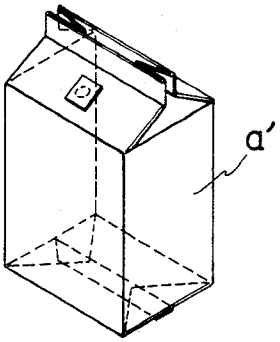
Figure 2F:
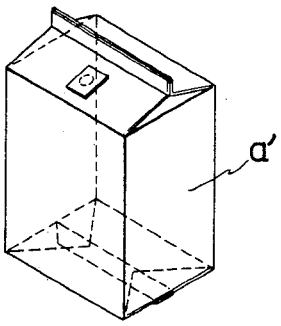

In the case where the carton is of the gable top type, the above-explained collapsing action is not performed after the linear sealing operation. In this case, the carton a' takes a form as shown in FIG. 2E.

Figure 1F:
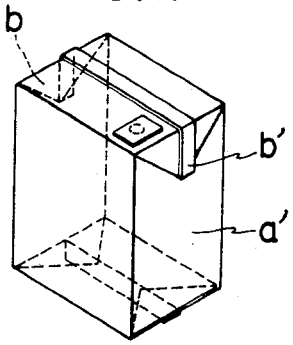

When the carton is of the gable top type, the cartons a', after completion of the sealing of the top subsequently to the above-explained series of operations, is ejected from the bucket portion 21 by an ejecting device to finish the whole process. In contrast, in the event that the carton is of the flat top type, it is necessary to treat the triangular lugs b,b' formed at both sides of the carton as shown in FIG. 1E, by folding the lugs and bonding the same onto the side surfaces c,c' of the carton a' as illustrated in FIG. 1F.

Figure 21:
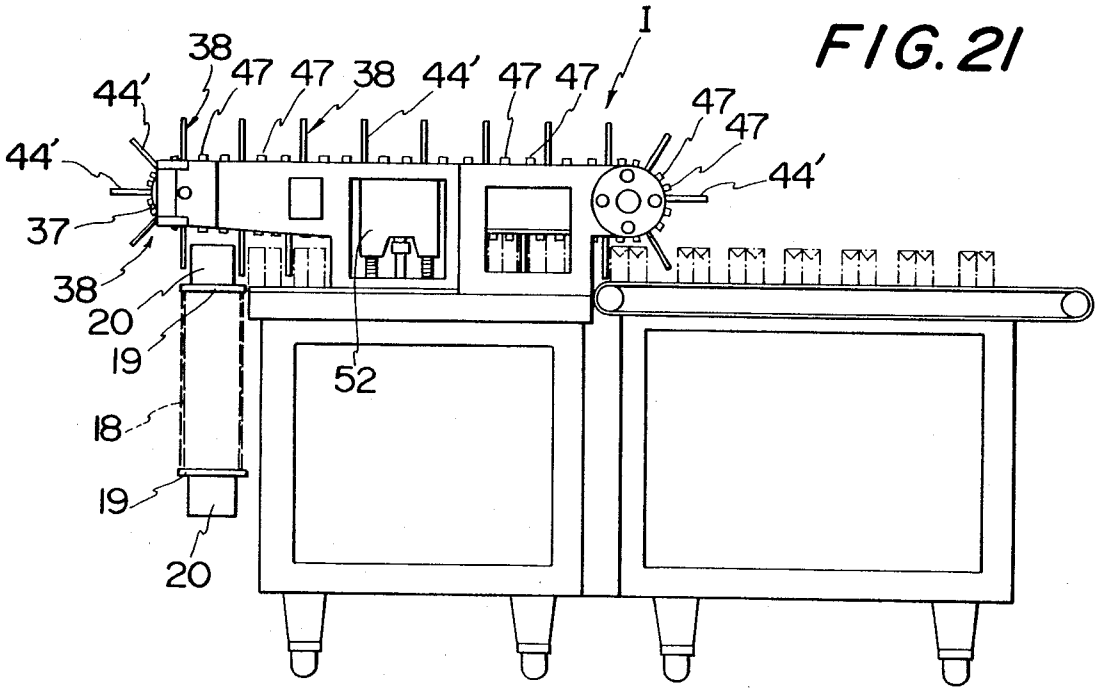
FIG. 21 is a right side elevational view of the automatic carton packing machine shown in FIGS. 3 and 4.
Figure 23:
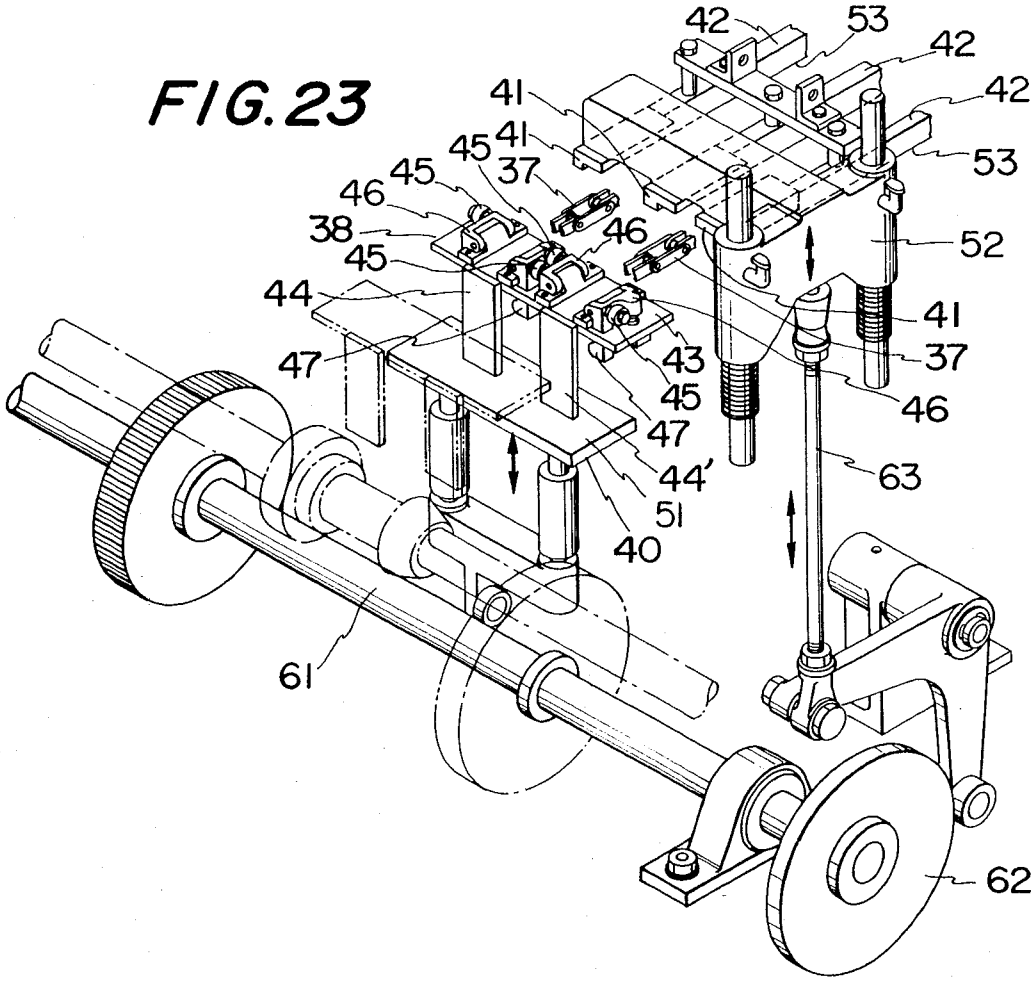
FIG. 23 is a perspective view of a clamping mechanism.

This operation is performed by the device I shown in FIGS. 3, 4 and in FIGS. 21 and 23.

Hereinafter, the operation of this device will be described in detail.

The construction of this treating device is shown at FIGS. 3,4 and 21 to 23. More specifically, the treating device I includes, as its major parts, a clamp conveyor 37 arranged at a right angle to the direction of running of the bucket portions 21 and adapted to run in synchronization with the intermittent running of the conveyor device D, clamp sets 38 secured to the clamp conveyor 37 at the same spacing and width as the bucket portions 21, a hot-air blower adapted to heat, during running of the clamp set 38, the lugs b,b' of the carton a' and the portions of the side surfaces c,c' of the carton a' onto which the lugs b,b' are to be folded and sealed to melt the film of plastic such as polyethylene coating the surface of the carton, a push-up device 40 for Pushing up the carton a' after application of hot air, a clamp cam adapted to make the clamp sets 38 run while maintaining the lugs b,b' of the carton a' in their downwardly bent portion and a clamp activating cam 42 adapted to release the clamp sets 38 after the fusion welding or bonding of the lugs b,b' to permit the carton a' to be ejected.

The operation of each part of the treating device I, having the above-described construction, follows. The clamp set 38 includes, as shown in FIG. 23, a base plate 43 attached to the clamp conveyor 37, back pressing plates 44,44' attached to the rear end as viewed in the direction of running of the base plate 43 and extending in the vertical direction, driven members 46 provided at four points on the upper surface of the base plate 43 and having guide wheels 45, and eight clamp members 47 pivotally carried by the drive members 46 to extend downwardly from the lower face of the base plate 43, the clamp members being so constructed as to bend the lugs b,b' downwardly and to clamp the same from both sides of the carton and being normally biased in the opening position.

Figure 22:
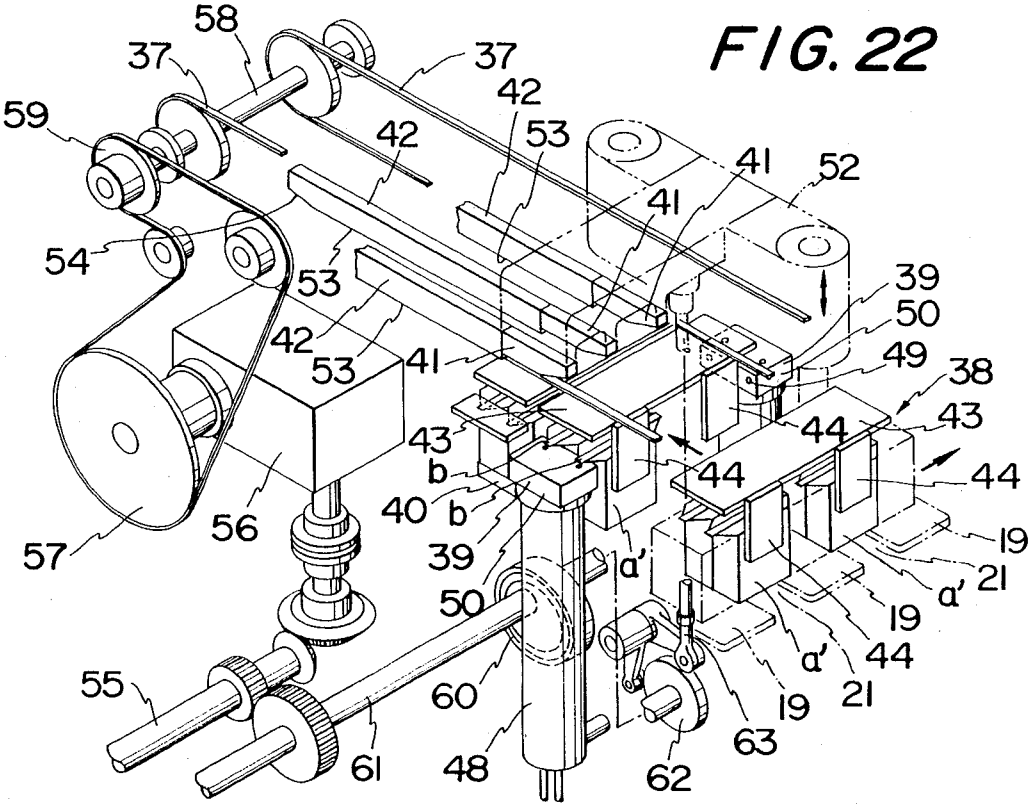
FIG. 22 is a perspective view of a part of a device for treating triangular lugs.

The hot-air blower 39 includes, as shown in FIG. 22, a hot-air generator 48 incorporating a cartridge heater therein and a head 50 including hot-air nozzles 49 attached to the upper end of the hot-air generator 48. The hot-air blower is adapted to blow hot air, when the carton a' is stopped, against the lugs b,b' and the side surfaces c,c' of the carton a' to melt the plastic film on the surfaces.

Referring now to the push-up device 40, this device includes a push-up base 51 adapted for pushing up the carton a' vertically upwardly as illustrated in FIG. 23. As the carton a' mounted on this push-up base 51 is pushed up, the lugs b,b' of the carton a' are pressed against rounded portions formed on the ends of the clamp members 47 thereby to bend the lugs b,b' downwardly at 90°.

The clamp cam 41 is secured to a clamp cam carrier 52 which is positioned above the push-up base 51 during running of the clamp set 38 and adapted to move up and down. The clamp cam 41 is adapted to make contact with the guide wheels 45 of the clamp set 38 from the upper side of the latter to actuate the clamp members 47.

The clamp closing cam 42 is extended in the direction of running of the clamp set 38 to follow the clamp set 38 as shown in FIG. 22. This clamp closing cam 42 has a clamp surface 53 adapted to actuate the clamp members 47 by depressing the guide wheels 45 of the clamp set 38 thereby to keep the lugs b,b' of the carton a' in the clamped state, and a cam surface 54 adapted for releasing the clamp members 47.

In FIG. 22, a reference numeral 55 designates a main shaft, 56 designates an index drive gear box, 57 designates an index outlet shaft drive gear, 58 denotes a clamp set driving shaft, 59 designates a driving sprocket gear, 60 denotes an operation cam of the push-up base 51, 61 designates a second cam shaft, 62 designates an operation cam for the clamp cam carrier 52 and 63 designates a connecting lever.

Figure 24:
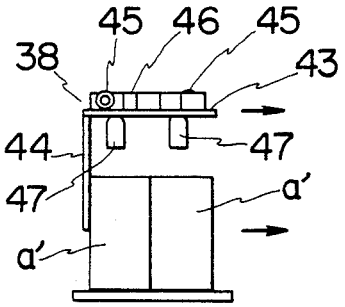
FIGS. 24 to 29 are illustrations of operations of the device for treating the triangular carton lugs.

This device operates in a manner explained hereinbelow. Two cartons a' accomodated in each of the successive bucket portions 21, are taken out by the back pushing plates 44 as shown in FIG. 24, while the bucket portions 21 are kept in the stopped state. The cartons a' thus taken out are horizontally moved on the table guide (not shown) by the clamp set 38 together with the latter, and are stopped at the position receive the blowing hot air made by the hot-air blower 39. Meanwhile, the bucket portions 21 run to bring the next cartons a' to the position where they are taken out by the clamp set 38.

Figure 25A:
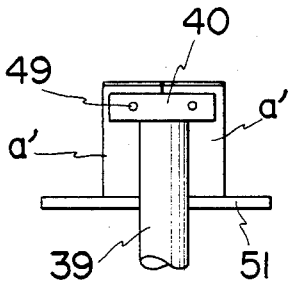
Figure 25B:
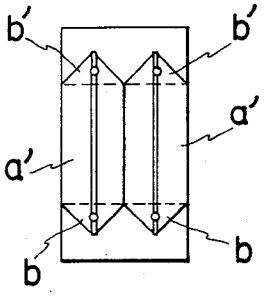

While the cartons a' are kept in their stopped state, hot air is blown from the nozzles 49 of the hot-air blower 39 to heat the back sides of the lugs b,b' of the cartons a' and the side surfaces c,c' thereof, thereby melting the plastic film as shown in FIGS. 25A and 25B. After the melting of the plastic film, the cartons a' are moved again by the clamp set 38 and are made to stop on the push-up base 51.

Figure 26A:
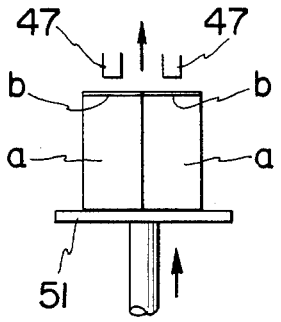
Figure 26B:
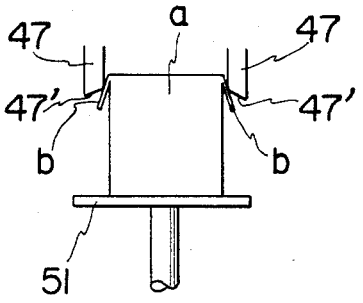
Figure 27:
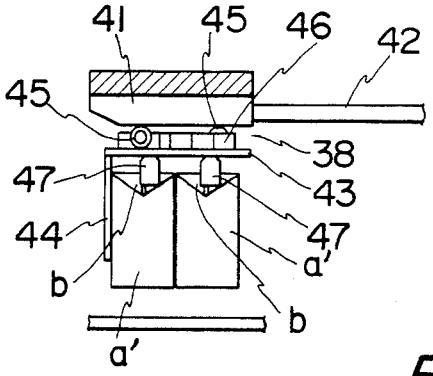

While the cartons a' rest on the push-up base 51 and the clamp set 38 is stopped, the push-up base 51 is moved upwardly as shown in FIG. 26A, so that, during this upward movement, the lugs b,b' of the cartons a' are brought into contact with the rounded parts 47' of the clamp members 47 to bend the lugs downwardly substantially at 90°. Then, as the upward movement of the push-up base 51 is ceased, the clamp cam carrier 52 is lowered as shown in FIG. 27, so that the clamp cam 41 comes into contact with the guide wheels 45 of the clamp set 38 thereby to drive the driven member 46 to reduce the clearance between adjacent clamp members 47 to clamp the lugs b,b' of the cartons a' from the outer sides.

Figure 28:
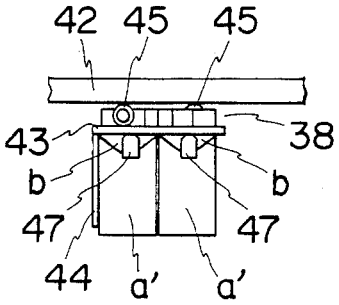
Figure 29:
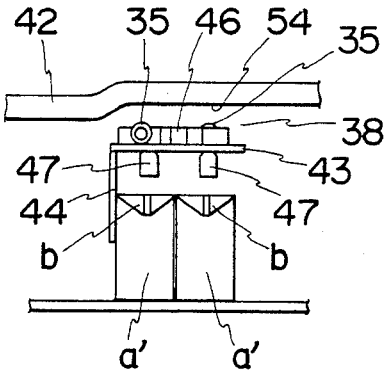

After this clamping operation, the push-up base 51 is moved downwardly so that the cartons a' are suspended from the clamp members 47 of the clamp set 38. The clamp set 38 is moved in this state, so that the guide wheels 45 leave the clamp cam 41 and come to contact the clamp closing cam 42. Accordingly, the clamp members 47 are held in such a state as to suspend the cartons a' as shown in FIG. 28, during which the lugs b,b' are heat-sealed and cooled by air to complete the sealing of the carton tops. Thereafter, the guide wheels 45 reach the releasing cam surface 54 as illustrated in FIG. 29, so that the guide wheels 45 are reset upwardly by the force of a spring to release the clamp members 47. In consequence, the cartons a' are released from the clamp members 47 and fall onto the table guide and are Pushed again by the back pushing plates 44. The series of packing operations is thus completed.

In the illustrated embodiment, the downward bending of the lugs b,b' of the cartons a' is achieved by rounded portions 47' of the clamp members 47 to which the lugs are pressed as the cartons a' are pushed up. This arrangement, however, is not exclusive, and the downward bending of the lugs b,b' may be effected by a baffle plate or the like provided separately from the clamp members 47.

As has been described, the treating device I for treating the triangular lugs is arranged at a right angle to the direction of running of the bucket 21, so that the lugs b,b' of the cartons a' are treated to provide a perfectly flattened form of the carton tops. This device I permits a reduction of the size of the whole machine and a safe treatment of the lugs formed on the carton top without fail.

In the illustrated embodiments, two cartons a' are taken out simultaneously from each of two bucket portions 21, i.e. four cartons a' are taken out simultaneously, due to a dual system arrangement. According to the invention, however, it is possible to handle 6 or 8 cartons a' at a time, by adopting a triple or quadruple system arrangement. Namely, according to the invention, it is possible to obtain a remarkable increase of the treating capacity in a comparatively easy manner without requiring a substantial increase of the installation space.

As has been described, the present invention offers, by a combination of a novel shifting device C, conveyor device D, folding device F and a treating device I for treating the triangular lugs, various advantages such as increased efficiency of the works for forming the cartons, filling of the cartons, sealing of the carton tops and treatment of the lugs on the carton tops to enhance the efficiency of the production of packs. In addition, the size of the machine as a whole is conveniently reduced. Furthermore, it is quite advantageous that cartons of flat top type and cartons of gable top type are handled by the same machine.

What is claimed is:

1. A carton shifting device for use in an automatic carton packing machine, said carton shifting device comprising:

an intermittently rotatable, generally horizontally oriented disc having a plurality of downwardly extending mandrels, each for receiving a carton blank, said mandrels connected to said disc in pairs, each pair of mandrels having an outwardly facing surface lying in a common plane with a groove in said outwardly facing surface;

a withdrawing bar having a length to span a distance between each mandrel in a pair of mandrels and extending horizontally;

a pair of claws connected to said withdrawing bar, each claw positioned to engage one mandrel of a pair of mandrels;

drive means connected to said withdrawing bar for driving said withdrawing bar downwardly to move said claws in respective grooves of respective mandrels to remove a carton blank from each mandrel in a downward direction;

a horizontal table for receiving carton blanks from said mandrels;

a push-out bar positioned to push carton blanks on said table by a distance corresponding substantially to the width of one carton blank;

a guiding frame space from said withdrawing bar for receiving carton blanks pushed by said push-out bar and aligning said carton blanks in a pair of rows; and a conveyor device arranged at an end of said guide frame, and for horizontal movement at a right angle to a direction in which said push-out bar pushes carton blanks, said conveyor device including a chain conveyor and a plurality of rectangular blocks to secure to said chain conveyor at spaced locations on said chain conveyor with a space between adjacent blocks corresponding to a length of a carton blank to be pushed by said push-out bar, each block having a width at least twice the width of a carton blank for accommodating two carton blanks in each space between adjacent blocks in side to side relationships.

2. A carton shifting device according to claim 1, including a stop rail extending in a directional movement of said conveyor device and on a side of said conveyor device spaced away from said push-out bar, said rail having a length greater than a plurality of blocks and spaces on said chain conveyor.

* * * * *